US011231678B2

(12) United States Patent
Miyake

(10) Patent No.: US 11,231,678 B2
(45) Date of Patent: Jan. 25, 2022

(54) IMAGE FORMING APPARATUS

(71) Applicant: KYOCERA Document Solutions Inc., Osaka (JP)

(72) Inventor: Masayuki Miyake, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 62 days.

(21) Appl. No.: 16/683,822

(22) Filed: Nov. 14, 2019

(65) Prior Publication Data

US 2020/0159158 A1 May 21, 2020

(30) Foreign Application Priority Data

Nov. 16, 2018 (JP) ..... JP2018-215624

(51) Int. Cl.
*G03G 15/00* (2006.01)
*B41J 11/00* (2006.01)
*B31D 5/00* (2017.01)

(52) U.S. Cl.
CPC ..... *G03G 15/70* (2013.01); *B41J 11/006* (2013.01); *B31D 5/0043* (2013.01)

(58) Field of Classification Search
CPC ..... G03G 15/70; B41J 11/006; B31D 5/0043
See application file for complete search history.

(56) References Cited

U.S. PATENT DOCUMENTS 7,489,881 B2 * 2/2009 Yasukawa ..... G03G 15/70 399/8
2005/0062676 A1 * 3/2005 Ohnuki ..... G06F 3/04883 345/1.2
2007/0144367 A1 * 6/2007 Mori ..... B41L 13/06 101/117
2011/0228988 A1 * 9/2011 Wu ..... G06T 7/0006 382/112
2011/0261105 A1 * 10/2011 Makley ..... B41J 11/009 347/19
2012/0011434 A1 * 1/2012 Zuev ..... G06K 9/00456 715/235
2017/0097798 A1 * 4/2017 Kuroda ..... G06F 3/1204
2017/0109107 A1 * 4/2017 Kuroda ..... G06F 3/121

FOREIGN PATENT DOCUMENTS

JP 2011059451 A 3/2011

* cited by examiner

*Primary Examiner* — David H Banh
(74) *Attorney, Agent, or Firm* — Studebaker & Brackett PC

(57) ABSTRACT

An image forming apparatus is an apparatus that forms an image on paper and provided with a sensor section, a determination section, and an estimation section. The sensor section outputs a signal indicating a state of the paper. The determination section determines whether or not each of a plurality of error conditions relating to a paper error is satisfied based on the signal output by the sensor section. The estimation section estimates an occurrence factor of the paper error based on a satisfaction pattern of the plurality of error conditions.

6 Claims, 6 Drawing Sheets

101

| Error condition / Occurrence factor | Mask position | Center position | Side position | Paper width | Paper length |
|---|---|---|---|---|---|
| Dog ear | Paper edge | Possible | Impossible | Possible | Either |
| Paper perforation | Within paper | Possible | Impossible | Possible | Impossible |
| Paper size error | Entirety | Either | Either | Possible | Possible |
| Paper setting displacement | Paper edge | Possible | Impossible | Possible | Impossible |
| Paper conveyance deviation | Entirety | Possible | Either | Possible | Possible |

Possible: detectable

Either: may be detectable

Impossible: not detectable

101

| Error condition / Occurrence factor | Mask position | Center position | Side position | Paper width | Paper length |
|---|---|---|---|---|---|
| Dog ear | Paper edge | Possible | Impossible | Possible | Either |
| Paper perforation | Within paper | Possible | Impossible | Possible | Impossible |
| Paper size error | Entirety | Either | Either | Possible | Possible |
| Paper setting displacement | Paper edge | Possible | Impossible | Possible | Impossible |
| Paper conveyance deviation | Entirety | Possible | Either | Possible | Possible |

Possible: detectable

Either: may be detectable

Impossible: not detectable

FIG. 3

IMAGE FORMING APPARATUS

INCORPORATION BY REFERENCE

The present application claims priority under 35 U.S.C. § 119 to Japanese Patent Application No. 2018-215624, filed on Nov. 16, 2018. The contents of this application are incorporated herein by reference in its entirety.

BACKGROUND

The present disclosure relates to an image forming apparatus.

On detecting an occurrence of paper jam in a paper conveyance path, an image forming apparatus presents a message indicating the location of the jam to a user.

SUMMARY

An image forming apparatus according to the present disclosure is an image forming apparatus that forms an image on paper and provided with a sensor section, a determination section, and an estimation section. The sensor section outputs a signal indicating a state of the paper. The determination section determines whether or not each of a plurality of error conditions relating to a paper error is satisfied based on the signal output by the sensor section. The estimation section estimates an occurrence factor of the paper error based on the satisfaction pattern of the plurality of error conditions.

BRIEF DESCRIPTION OF THE DRAWINGS

FIG. 3 is a diagram illustrating an example of paper error information.

DETAILED DESCRIPTION

Figure 1:
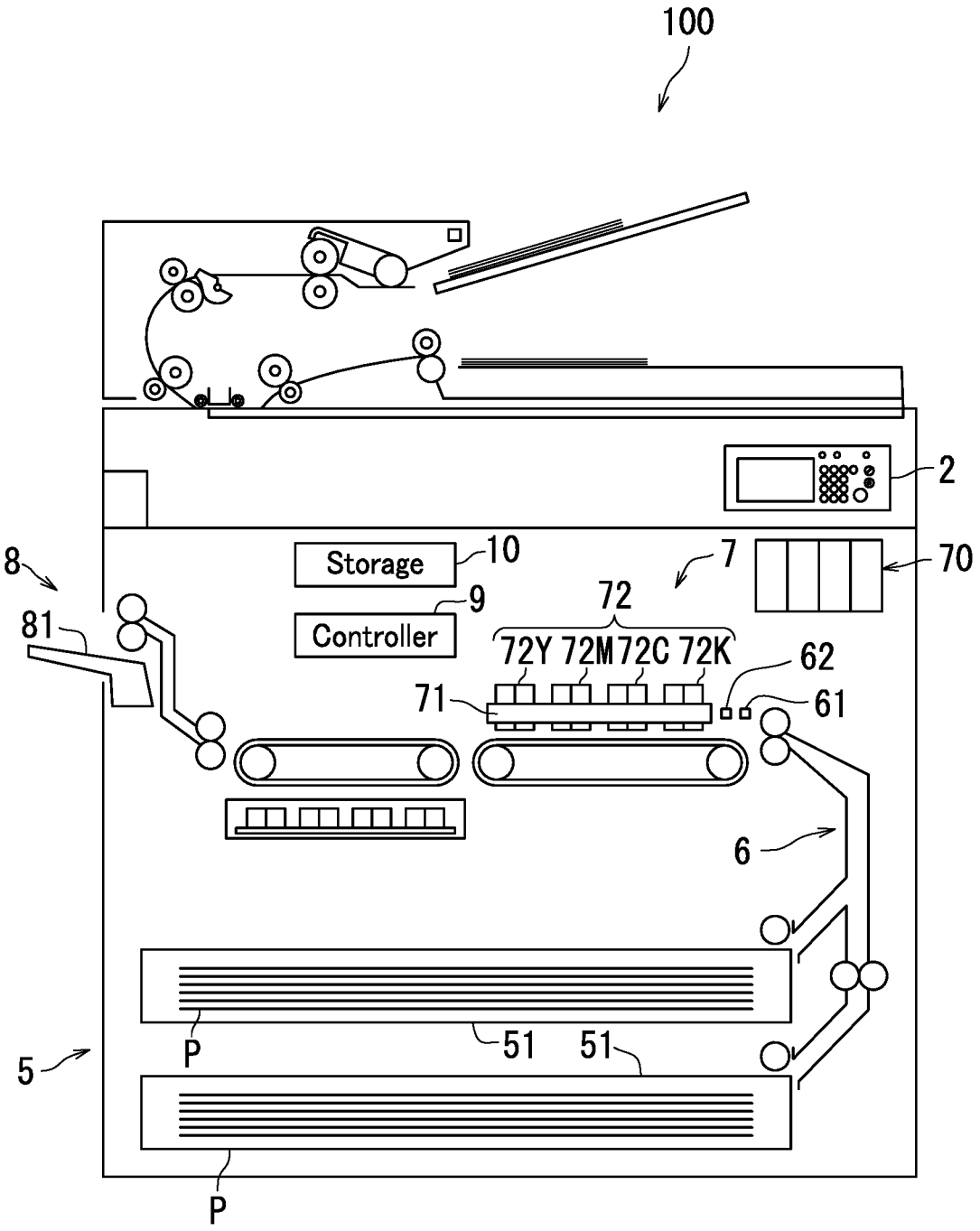
FIG. 1 is a diagram illustrating an example of an image forming apparatus according to an embodiment of the present disclosure.

The following describes embodiments of the present disclosure with reference to FIG. 1 to FIG. 6. In the drawings, the same or corresponding elements are assigned the same reference signs, and descriptions thereof are omitted.

First, with reference to FIG. 1, an image forming apparatus 100 according to an embodiment will be described. FIG. 1 is a diagram illustrating an example of the image forming apparatus 100. The image forming apparatus 100 according to the present embodiment is an inkjet recording apparatus that ejects inks to form an image on paper P.

As illustrated in FIG. 1, the image forming apparatus 100 includes an operation panel 2, a paper housing 5, a paper conveyance section 6, a recording section 7, ink supplying devices 70, an ejecting device 8, a controller 9, and storage 10.

The operation panel 2 receives a job instruction from a user to the image forming apparatus 100. The operation panel 2 includes a liquid-crystal display and a plurality of operation keys. On receiving an instruction from the user, the operation panel 2 sends a signal indicating the instruction from the user to the controller 9. Furthermore, on receiving a signal indicating a message from the controller 9, the operation panel 2 displays the message from the controller 9 to the user.

The paper housing 5 includes a plurality of cassettes 51. Each cassette 51 accommodates paper P. The paper P fed from the cassette 51 is conveyed to the paper conveyance section 6.

The paper conveyance section 6 conveys the paper P in such a manner that the paper passes below the recording section 7. The paper conveyance section 6 further conveys the paper P having passed below the recording section 7 to the ejecting device 8. The paper conveyance section 6 includes an image sensor 61 and a passage sensor 62.

The image sensor 61 outputs a signal indicating an image of the paper P in a direction perpendicular to a conveyance direction of the paper P. The image sensor 61 is, for example, a contact image sensor (CIS) unit. The CIS unit includes a light-emitting diode (LED), an imaging lens, and an image reading sensor. Output signal of the image sensor 61 is input to the controller 9.

The passage sensor 62 outputs a signal indicating whether or not the paper P is present on the conveyance path of the paper P. The passage sensor 62 includes a light emitting element and a light receiving element. The light receiving element receives light emitted from the light emitting element. When the paper P is present between the light emitting element and the light receiving element, the light emitted from the light emitting element is blocked. When the paper P is not present between the light emitting element and the light receiving element, the light emitting element receives the light emitted from the light emitting element. The output signal of the passage sensor 62 is input to the controller 9.

The recording section 7 ejects inks to record the image on the paper P. The recording section 7 includes a head housing 71 and four line heads 72. The head housing 71 supports the four line heads 72. The four line heads 72 each eject an ink of a color corresponding thereto.

The line head 72 that ejects a yellow ink is indicated as a line head 72Y. The line head 72 that ejects a magenta ink is indicated as a line head 72M. The line head 72 that ejects a cyan ink is indicated as a line head 72C. The line head 72 that ejects a black ink is indicated as a line head 72K.

The ink supplying devices 70 supply inks to the recording section 7. The ink supplying devices 70 includes a first ink supplying device, a second ink supplying device, a third ink supplying device, and a fourth ink supplying device. The first ink supplying device supplies the yellow ink to the line head 72Y. The second ink supplying device supplies the magenta ink to the line head 72M. The third ink supplying device supplies the cyan ink to the line head 72C. The fourth ink supplying device supplies the black ink to the line head 72K.

The ejecting device 8 includes an exit tray 81. The ejecting device 8 ejects the paper P out of a main body housing of the image forming apparatus 100. The paper P ejected to the outside of the main body housing is placed on the exit tray 81.

The controller 9 includes a processor such as a central processing unit (CPU). The controller 9 controls the operation of each section of the image forming apparatus 100 through executing control programs.

The storage 10 stores the control programs and data therein. The storage 10 includes a storage device and semiconductor memory. The storage device includes, for example, a hard disk drive (HDD). The semiconductor memory includes, for example, random-access memory (RAM) and read-only memory (ROM).

Figure 2:
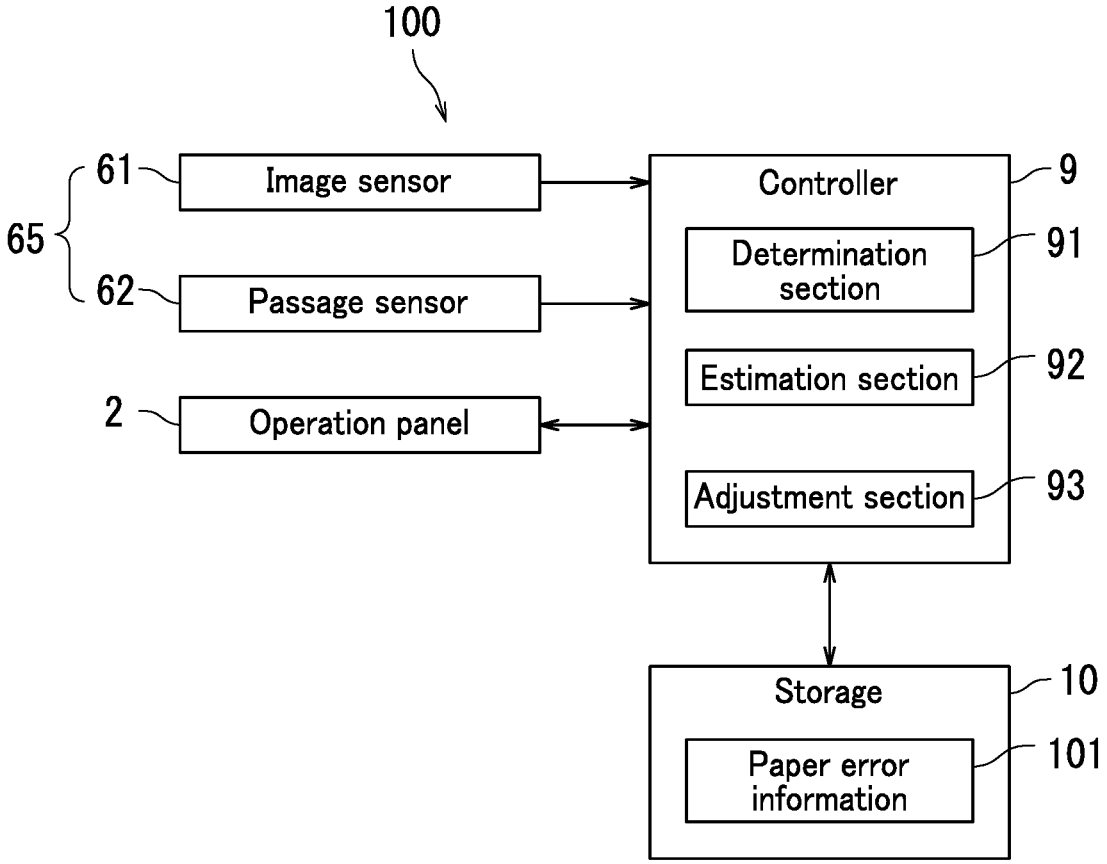
FIG. 2 is a block diagram illustrating an example of a configuration of a controller.

Next, a configuration of the controller 9 will be described with reference to FIGS. 1 and 2. FIG. 2 is a block diagram illustrating an example of the controller 9.

As illustrated in FIG. 2, the controller 9 includes a determination section 91, an estimation section 92, and an adjustment section 93. Specifically, the processor of the controller 9 functions as the determination section 91, the estimation section 92, and the adjustment section 93 by executing the control programs stored in the storage 10. The storage 10 further stores paper error information 101. The operation panel 2 is connected to the controller 9 therein. The output signals of the image sensor 61 and the passage sensor 62 are input to the controller 9. The image sensor 61 and the passage sensor 62 function as a sensor section 65 that outputs a signal indicating a state of the paper P.

The determination section 91 determines whether or not five error conditions relating to a paper error are each satisfied based on the output signal of the sensor section 65. Specifically, the determination section 91 first analyzes the image of the paper P represented by the output signal of the image sensor 61 to determine a width (paper width), a center position (paper center position), and a side position (paper side position) of the paper P in the direction perpendicular to the conveyance direction of the paper P. Then, the determination section 91 determines whether or not the determined paper width is within an allowable range. When the determined paper width is within the allowable range, the determination section 91 determines that an error condition relating to the paper width is not satisfied. When the determined paper width is not within the allowable range, the determination section 91 determines that the error condition relating to the paper width is satisfied. In this way, the determination section 91 determines whether or not the error condition relating to the paper width is satisfied. Similarly, the determination section 91 determines whether or not respective error conditions relating to the center position and the side position are satisfied.

Further, the determination section 91 analyzes the image of the paper P represented by the output signal of the image sensor 61 to determine whether or not there are any problem that may cause blots in the recording section 7 as a result of ink ejection. When the paper P is not present at a position where the paper should be present, the position where the paper is absent is masked to restrict ink ejection not contributing to image formation. As a result, blots in the recording section 7 can be prevented from being made. To achieve the prevention, the determination section 91 determines whether or not an error condition relating to a mask position is satisfied. When the error condition relating to the mask position is satisfied, the determination section 91 makes further determination relating to the mask position where the paper is absent. For example, the determination section 91 determines whether the mask position is on a paper edge or within the paper. When the paper is recognized to be absent from both on the paper edge and within the paper, the determination section 91 determines that the mask position will lie on the entirety.

Further, the determination section 91 analyzes the output signal of the passage sensor 62 to obtain the duration of time for which the light emitted from the light emitting element is blocked by the paper P, and determines a length of the paper P (paper length) in the conveyance direction of the paper P based on the obtained duration of time. Then, the determination section 91 determines whether or not the determined paper length is within an allowable range. When the determined paper length is within the allowable range, the determination section 91 determines that the error condition relating to the paper length is not satisfied. When the determined paper length is not within the allowable range, the determination section 91 determines that the error condition relating to the paper length is satisfied. In this way, the determination section 91 determines whether or not the error condition relating to the paper length is satisfied.

The estimation section 92 refers the paper error information 101 to estimate an occurrence factor of the paper error based on a satisfaction pattern of the five error conditions. The operation panel 2 functions as a display section that displays an estimated occurrence factor.

Specifically, the estimation section 92 estimates at least one of a dog ear, paper perforation, a paper size error, paper setting displacement, and paper conveyance deviation as a paper error occurrence factor. The dog ear is a problem in which an edge of the paper P being fed for image forming is folded. The paper perforation is a problem in which the paper P being fed for image forming is perforated. The paper size error is a problem in which the size of the paper P set in the cassette 51 is different from the paper size specified in a job. The paper setting displacement is a problem in which the paper P set in the cassette 51 is displaced. The paper conveyance deviation is a problem in which the paper P being conveyed in the paper conveyance section 6 skews significantly.

In a case where the estimation section 92 estimates a plurality of occurrence factors, the adjustment section 93 adjusts the display order so that the occurrence factors are displayed on the operation panel 2 in order of priority.

Next, the paper error information 101 will be described with reference to FIG. 3. FIG. 3 is a diagram illustrating an example of the paper error information 101.

As illustrated in FIG. 3, the paper error information 101 indicates relationship between the five error conditions and the five occurrence factors. The five error conditions include the mask position, the center position, the side position, the paper width, and the paper length. The five occurrence factors include the dog ear, the paper perforation, the paper size error, the paper setting displacement, and the paper conveyance deviation. In FIG. 3, Possible indicates "detectable", Either indicates "may be detectable", and Impossible indicates "not detectable".

Figure 4A:
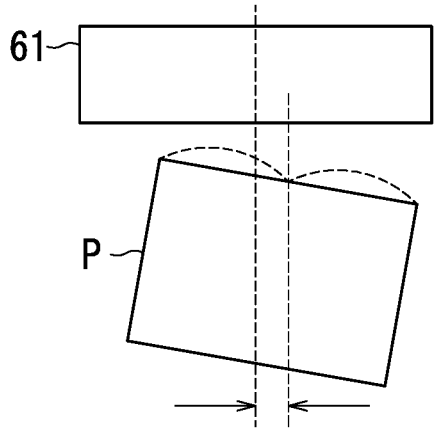
FIG. 4A, FIG. 4B, and FIG. 4C are diagrams illustrating three occurrence factors for a paper error assumable from an error condition relating to a center position being satisfied in a paper error.
Figure 4B:
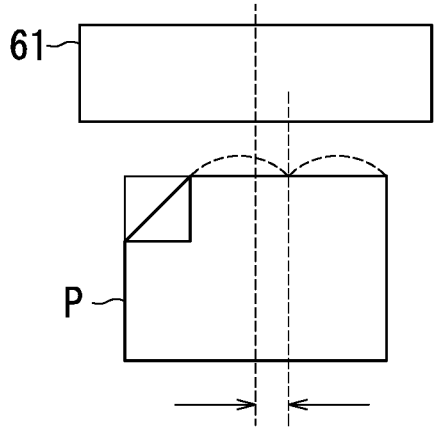
Figure 4C:
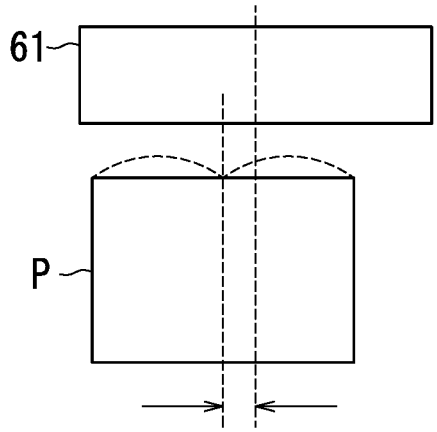

Next, occurrence factors for the center position error of the paper P will be described with reference to FIG. 1 to FIG. 3, FIG. 4A, FIG. 4B, and FIG. 4C. FIG. 4A, FIG. 4B, and FIG. 4C are diagrams illustrating three occurrence factors for a paper error assumable from the error condition of the center position being satisfied.

As illustrated in FIG. 4A, when the paper P in the cassette 51 is set at a displaced position, the paper P is conveyed to the position of the image sensor 61 in an inclined posture with respect to the image sensor 61. Accordingly, the center of the paper P does not coincide with the center of the image sensor 61 in the direction perpendicular to the conveyance direction of the paper P. Based on the output signal of the image sensor 61, the determination section 91 determines that the error condition relating to the center position is satisfied. That is, a paper error relating to the "center position" of which an occurrence factor is the "paper setting displacement" is detectable. This is reflected in the element "Possible" at a location in the row of "Paper setting displacement" and the column of "Center position" in FIG. 3.

As illustrated in FIG. 4B, in a situation in which the paper P has a dog ear, the center of the leading edge of the paper P does not coincide with the center of the image sensor 61 in a direction perpendicular to the conveyance direction of the paper P. Based on the output signal of the image sensor 61, the determination section 91 determines that the error condition relating to the center position is satisfied. That is, a paper error relating to the "center position" of which an occurrence factor is the "dog ear" is detectable. This is reflected in the element "Possible" at a location in the row of "Dog ear" and the column of "Center position" in FIG. 3.

As illustrated in FIG. 4C, when conveyance skew of the paper P is significant, the center of the paper P does not coincide with the center of the image sensor 61 in the direction perpendicular to the conveyance direction of the paper P. Based on the output signal of the image sensor 61, the determination section 91 determines that the error condition relating to the center position is satisfied. That is, a paper error relating to the "center position" of which an occurrence factor is the "paper conveyance deviation" is detectable. This is reflected in the element "Possible" at a location in the row of "Paper conveyance deviation" and the column of "Center position" in FIG. 3.

Figure 5A:
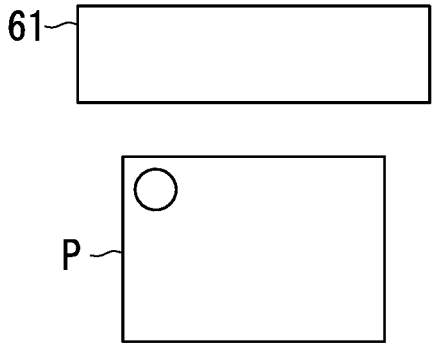
FIG. 5A and FIG. 5B are diagrams illustrating two occurrence factors for a paper error assumable from a mask position error condition being satisfied.
Figure 5B:
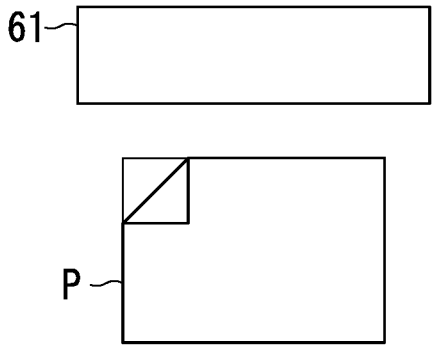

Next, occurrence factors for the mask position error for the paper P will be described with reference to FIG. 1 to FIG. 3, FIG. 5A, and FIG. 5B. FIG. 5A and FIG. 5B are diagrams illustrating two occurrence factors for a paper error assumable from the mask position error condition being satisfied.

As illustrated in FIG. 5A, when the paper P is perforated, the determination section 91 determines that the error condition relating to the mask position is satisfied based on the output signal of the image sensor 61. That is, a paper error relating to the "mask position" of which an occurrence factor is the "paper perforation" is detectable. This is reflected in the element "Inside paper" at a location in the row of "Paper with hole" and the column of "Mask position" in FIG. 3.

As illustrated in FIG. 5B, in a situation in which the paper P has a dog ear at an edge thereof, the determination section 91 determines that the error condition relating to the mask position is satisfied based on the output signal of the image sensor 61. That is, a paper error relating to the "mask position" of which an occurrence factor is the "dog ear" is detectable. This is reflected in the element "Paper edge" at a location in the row of "Dog ear" and the column of "Mask position" in FIG. 3.

Even in a situation in which the paper P has a dog ear at an edge thereof, when the size of the dog ear is small, the determination section 91 determines that the error condition relating to the paper length is not satisfied based on the output signal of the passage sensor 62. When the size of the dog ear is large and therefore the dog ear passes between the light emitting element and the light receiving element of the passage sensor 62, the determination section 91 determines that the error condition relating to the paper length is satisfied based on the output signal of the passage sensor 62. That is, it is possible that a paper error relating to the "paper length" of which an occurrence factor is the "dog ear" is detectable or not detectable depending on the situation. This is reflected in the element "Either" at a location in the row of "Dog ear" and the column of "Center position" in FIG. 3.

Even if the paper P has a hole therein, the perforation does not influence on the length of the paper P in the conveyance direction of the paper P. Even in a situation in which the paper P is perforated, the determination section 91 determines that the error condition relating to the paper length is not satisfied based on the output signal of the passage sensor 62. That is, a paper error relating to the "paper length" of which an occurrence factor is the "paper perforation" is not detectable. This is reflected in the element "Impossible" at a location in the row of "Paper perforation" and the column of "Paper length" in FIG. 3.

Descriptions of the other elements in the paper error information 101 in FIG. 3 are omitted.

Figure 6:
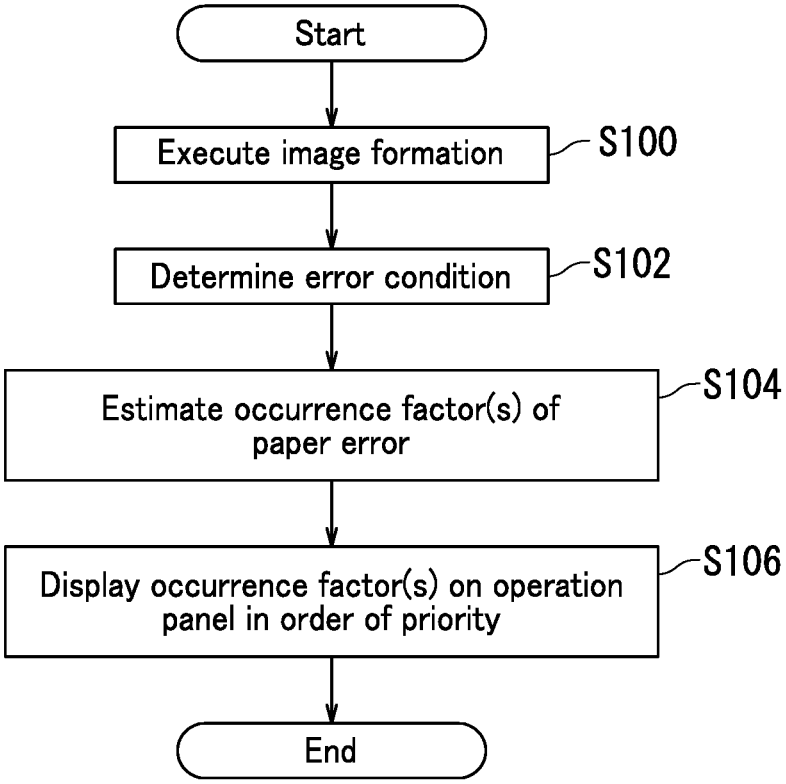
FIG. 6 is a flowchart illustrating an example of operation of the controller.

Next, operation of the controller 9 will be described with reference to FIG. 1 to FIG. 3, and FIG. 6. FIG. 6 is a flowchart illustrating an example of the operation of the controller 9.

Step S100: The controller 9 controls each of the paper conveyance section 6, the recording section 7, the ink supplying devices 70, and the ejecting device 8 so that image formation is executed.

Step S102: The controller 9 determines whether or not each of the five error conditions relating to a paper error is satisfied based on the output signals of the image sensor 61 and the passage sensor 62. When any of the error conditions is satisfied, the controller 9 suspends image formation.

Step S104: The controller 9 refers the paper error information 101 to estimate an occurrence factor of the paper error based on the satisfaction pattern of the five error conditions.

For example, it is assumed that the error condition of the mask position is satisfied for the "paper edge", the error conditions of the center position, the paper width, and the paper length are satisfied, and the error condition of the side position is not satisfied. In this case, the controller 9 refers to the paper error information 101 to estimate the occurrence factor of the paper error being "dog ear".

Step S106: The controller 9 displays the estimated occurrence factor on the operation panel 2. In a situation in which a plurality of occurrence factors are estimated, the controller 9 controls the display order so that the plurality of occurrence factors are displayed on the operation panel 2 in order of priority. The priority is determined in such a manner that a factor with a higher possibility of occurrence has a higher priority, for example.

For example, it is assumed that the error condition of the mask position is satisfied for the "paper edge", the error conditions of the center position and the paper width are satisfied, and the error conditions of the side position and the paper length are not satisfied. In this case, the controller 9 refers to the paper error information 101 to estimate the occurrence factor of the paper error being "dog ear" or "paper setting displacement". Since the "paper setting displacement" has a higher possibility of occurrence than the "dog ear", "paper setting displacement" is displayed on the operation panel 2 prior to the "dog ear".

According to the present embodiment, the controller 9 estimates an occurrence factor of a paper error. Since the results of estimation are presented to the user by means of the operation panel 2, the user can obtain a clue to prevent a paper error from occurring. Therefore, user convenience is improved.

In the description of each embodiment described above, various technically preferable limitations may be given to illustrate a preferred embodiment in the present disclosure. However, the technical scope of the present disclosure is not limited to these embodiments unless otherwise specified by descriptions limiting the present disclosure. That is, the elements of configuration in the above-described embodiments can be appropriately replaced with existing constituent elements or the like, and various variations including combinations with other existing constituent elements are possible. The descriptions of the embodiments should not be construed as limitations on the contents of the disclosure described in the scope of claims.

(1) As illustrated with reference to FIG. 1, the image forming apparatus 100 is an inkjet recording apparatus in this embodiment, but the image forming apparatus 100 is not limited thereto. For example, the image forming apparatus 100 may be an electrophotographic recording apparatus.

(2) As illustrated with reference to FIG. 1 and FIG. 2, the sensor section 65 includes the image sensor 61 and the passage sensor 62 in this embodiment, but the sensor section 65 is not limited thereto. For example, the passage sensor 62 may be dispensed with.

(3) As illustrated with reference to FIG. 3, the paper error information 101 shows the relationship between the five error conditions and the five occurrence factors, but the paper error information 101 is not limited thereto. The number of the error conditions and the number of the occurrence factors included in the paper error information 101 are both not particularly limited.

What is claimed is:

1. An image forming apparatus that forms an image on paper, the apparatus comprising:

a sensor section configured to output a signal indicating a state of the paper;

storage that stores therein paper error information indicating a causal relationship between a plurality of error occurrence factors and a plurality of error conditions relating to respective paper errors; and a controller configured to determine whether or not each of the plurality of error conditions is satisfied based on the signal output by the sensor section and decide at least one error occurrence factor of the error occurrence factors based on a satisfaction pattern of the plurality of error conditions by referring to the paper error information.

2. The image forming apparatus according to claim 1, further comprising a display section configured to display the at least one error occurrence factor decided by the controller.

3. The image forming apparatus according to claim 2, wherein the controller includes an adjustment section configured to adjust, when the controller decides two or more error occurrence factors of the plurality of error occurrence factors, display order so that the two or more error occurrence factors decided by the controller are displayed on the display section in order of priority.

4. The image forming apparatus according to claim 1, wherein the sensor section includes:

an image sensor that outputs a signal indicating an image of the paper in a direction perpendicular to a conveyance direction of the paper; and a passage sensor that outputs a signal indicating whether or not the paper is present on a conveyance path of the paper.

5. The image forming apparatus according to claim 4, wherein the image forming apparatus is constituted as an inkjet recording apparatus, the plurality of error conditions includes an error condition relating to a paper width, an error condition relating to a paper center position, an error condition relating to a paper side position, an error condition relating to a paper length, and an error condition relating to a position where the paper is absent when the paper is not present at a position where the paper should be present, and the controller determines:

whether or not the error conditions relating to the paper width, the paper center position, and the paper side position in the direction perpendicular to the conveyance direction of the paper are satisfied based on the signal output by the image sensor;

whether or not the error condition relating to the position where the paper is absent is satisfied based on the signal output by the image sensor; and whether or not the error condition relating to the paper length in the conveyance direction of the paper is satisfied based on the signal output by the passage sensor.

6. The image forming apparatus according to claim 5, wherein the controller decides at least one of a dog ear, paper perforation, a paper size error, paper setting displacement, and paper conveyance deviation as the at least one error occurrence factor.

* * * * *